United States Patent [19]

Tamura et al.

[11] Patent Number: 4,744,611

[45] Date of Patent: May 17, 1988

[54] DISPLAY CABINET

[75] Inventors: Fumiyasu Tamura; Kenichi Nara; Ryoichi Takahashi, all of Maebashi, Japan

[73] Assignee: Sanden Corporation, Gunma, Japan

[21] Appl. No.: 847,522

[22] Filed: Apr. 3, 1986

[30] Foreign Application Priority Data

Apr. 4, 1985 [JP] Japan ..... 60-49245[U]
Mar. 3, 1986 [JP] Japan ..... 61-30218[U]

[51] Int. Cl.[4] ..... A47F 3/04
[52] U.S. Cl. ..... 312/116; 312/236
[58] Field of Search ..... 165/918, 919, 48 R; 62/252–254; 312/116, 236, 223

[56] References Cited

U.S. PATENT DOCUMENTS 2,618,128 11/1952 Walker ..... 62/254
3,301,166 1/1967 Schwartz ..... 312/236

*Primary Examiner*—Joseph Falk

*Attorney, Agent, or Firm*—Banner, Birch, McKie & Beckett

[57] ABSTRACT

A display case is provided with a compartment which stores merchandise for display and is divided into at least two chambers by a partition plate to enable storing different types of merchandise, each of which types is to be held under a predetermined temperature. These chambers communicate with one another through a communication gap which is defined between the partition plate and the window of the case and the opening and closing of the gap is controlled by a sealing mechanism to vary the temperature conditions within each chamber. The sealing mechanism includes a sealing element which is movably engaged with the partition plate and a retaining element is fastened on the partition plate to hold the selected position of the sealing element. Thus, the opening and closing control of the gap is easily operated without interfering with the visibility of the merchandise.

9 Claims, 6 Drawing Sheets

DISPLAY CABINET

BACKGROUND OF THE INVENTION

This invention relates to the field of merchandise display cases, and more particularly, to a dividing structure for the merchandise display case to provide it with a plurality of merchandise display or storage chambers to maintain different temperature areas.

In conventional merchandise displace cases, such as those used to display frozen foodstuff, beverage cans, etc., transparent glass windows are used to inrease visibility of the merchandise on display and a shelf or plate divides the display/storage compartment of the display case into two chambers, each of which is maintained at a different temperature to define a plurality of merchandise display/storage chambers. Therefore, several kinds of merchandise, each having different keeping temperatures from one another, can be stored within the display/storage chambers of the same case.

With reference to FIGS. 1 and 2, a conventional refrigerated display case will be described, As shown in FIG. 1, the refrigerated display case (generally indicated by reference numeral 1) comprises a merchandise display/storage chamber 5 mounted on a mechanical chamber 2 in which a refrigeration unit is disposed. Display/storage chamber 5 is defined by a front side window 3*a*, right and left side windows 3*b* and 3*c*, top plate 3*d* and door 4. Door 4 is hingedly supported on the case 1 so as to permit ready access to the interior of display/storage chamber 5. At least the side windows 3*a*, 3*b* and 3*c* are made of transparent material to increase the visibility of the merchandise stored in the display case.

In this structure of the display case, the interior of display/storage chamber 5 is divided into at least two chambers 5*a* and 5*b* by a plate 6, providing, for example, a heating chamber 5*a* formed in the upper portion of display/storage chamber 5 and a refrigerating or freezing chamber 5*b* formed below the heating chamber 5*a* and cooled down by the refrigerator unit. Therefore, different types of merchandise, each of which requires a different temperature for storing, can be stored within the same case.

On the other hand, both chambers 5*a* and 5*b* are connected to one another through a duct mechanism 7 disposed on the opposed peripheral edges of plate 6 to enable use of the display/storage chamber 5 as a wholly refrigerating or wholly heating chamber. Duct mechanisms 7, one being shown in FIG. 2, comprise an air passageway 7*a* defined between the side windows 3*b* and 3*c*, and the oppsite end surfaces of plate 6. A damper 7*b* extends horizontally within passageway 7*a* for opening and closing passageway 7*a*. Damper 7*b* is manually operated to accommodate the type of stored merchandise, i.e., if damper 7*b* is open to thereby open passageway 7*a*, the whole space of chamber 5 functions as a refrigerating chamber or a heatin chamber. Conversely, if damper 7*b* is closed to close passageway 7*a*, then the two chambers 5*a* and 5*b* defined by plate 6 are capable of being used as different temperature spaces. However, sine duct mechanisms 7 are disposed on the outer ends of plate 6 and therefore open to view, the appearance of the display case is not as good as desired.

SUMMARY OF THE INVENTION

It is a primary object of this invention to provide an improved display case with a chamber dividing mechanism which affords good visibility of the merchandise stored in the display case.

It is another object of this invention to provide a display case which is provided with an easily operated chamber dividing mechanism.

It is still another object of this invention to provide a display case provided with a chamber dividing mechanism which is disposed in the merchandise display space without interferring with the merchandise.

A display case in accordance with the present invention includes a compartment which stores merchandise for display. The display compartment is defined by a front side window, right and left side windows, a top plate portion and a door, and is divided into at least two chambers by a partition plate. The temperature condition of each chamber may be varied by controlling the opening and closing of a communication gap defined between an edge portion of the partition plate and the right or left side window. A sealing mechanism is disposed in the communication gap to control the opening and closing of the gap, and includes a sealing element movably engaged with the partition plate and a retaining element to hold the selected position of the sealing element.

Further objects, features and other aspects of this invention will be better understood from the following detailed description of preferred embodiments of this invention taken with reference to the annexed drawings.

BRIEF DESCRIPTION OF THE DRAWINGS

FIG. 4(*b*) is an enlarged exploded perspective view illustrating a damper element disposed on the partition plate of FIG. 4(*a*).

DETAILED DESCRIPTION OF THE PREFERRED EMBODIMENTS

Figure 1:
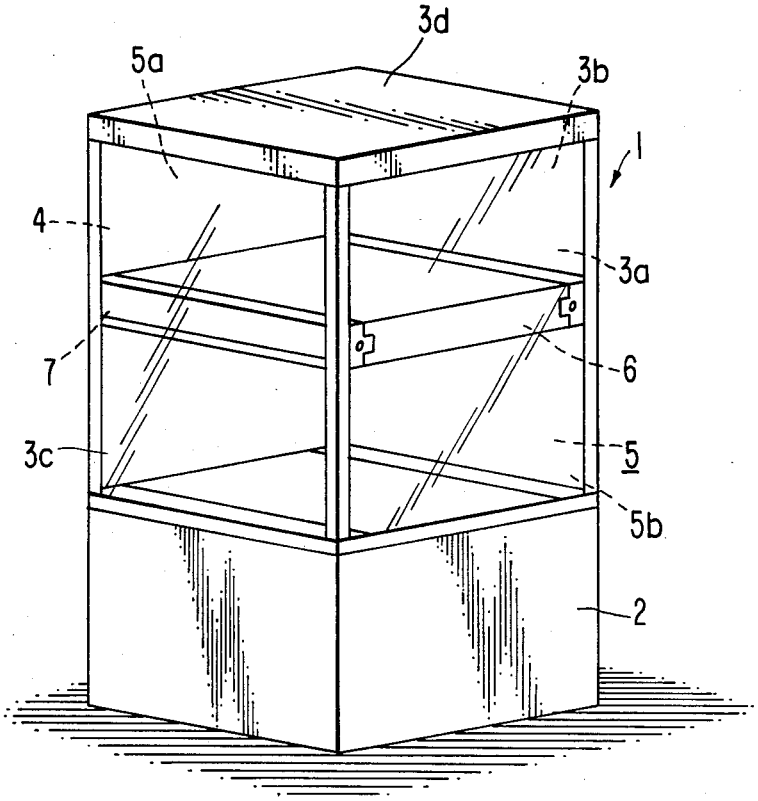
FIG. 1. (PRIOR ART)
FIG. 1 is a perspective view of a display case known in the prior art.
Figure 2:
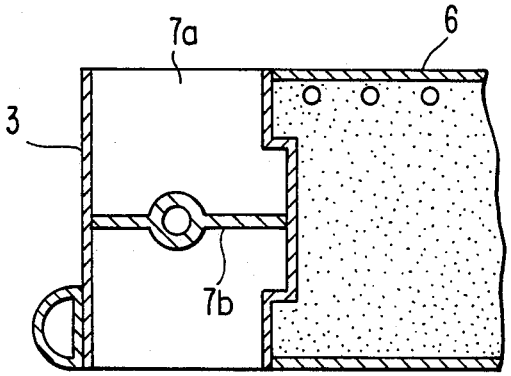
FIG. 2. (PRIOR ART)
FIG. 2 is an enlarged cross sectioal view illustrating the sealing structure for the partition plate used in the display case of FIG. 1.
Figure 3:
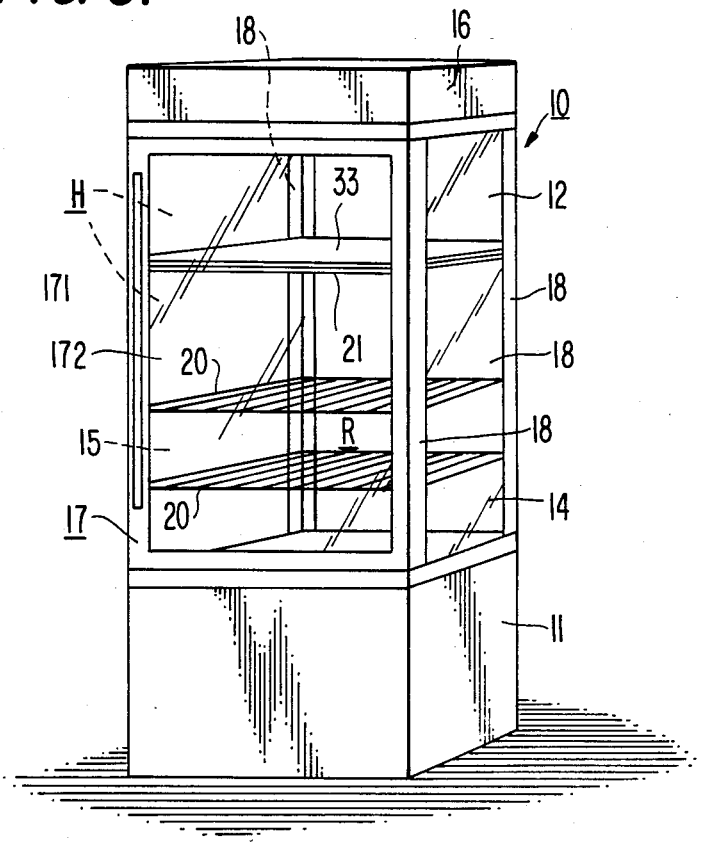
FIG. 3 is a perspective view of a display case in accordance with the present invention.
Figure 4A:
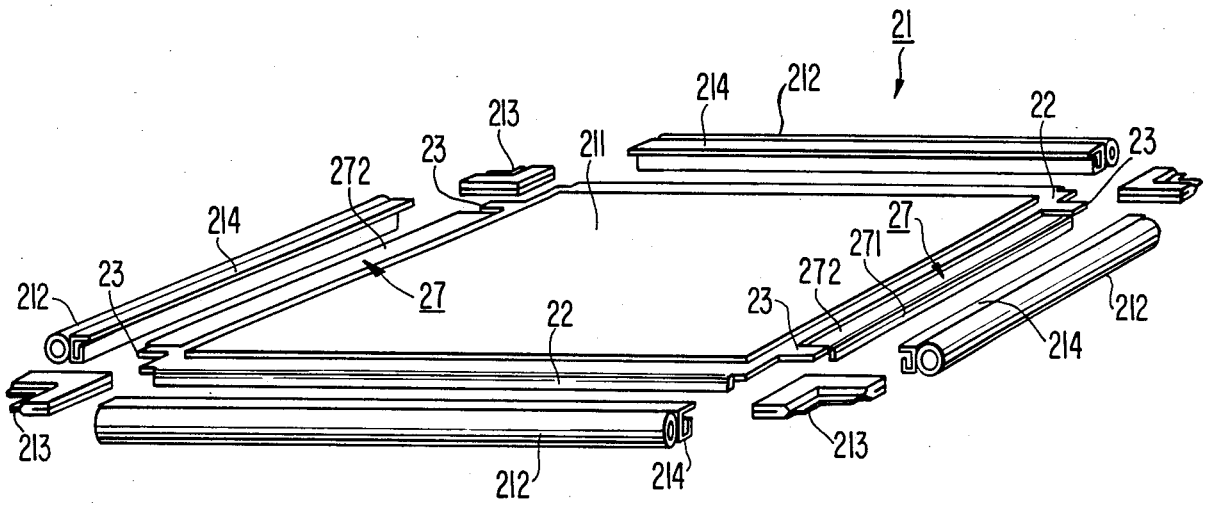
FIG. 4(*a*) is an exploded perspective view illustrating a partition plate utilized in the display case of FIG. 3.
Figure 4B:
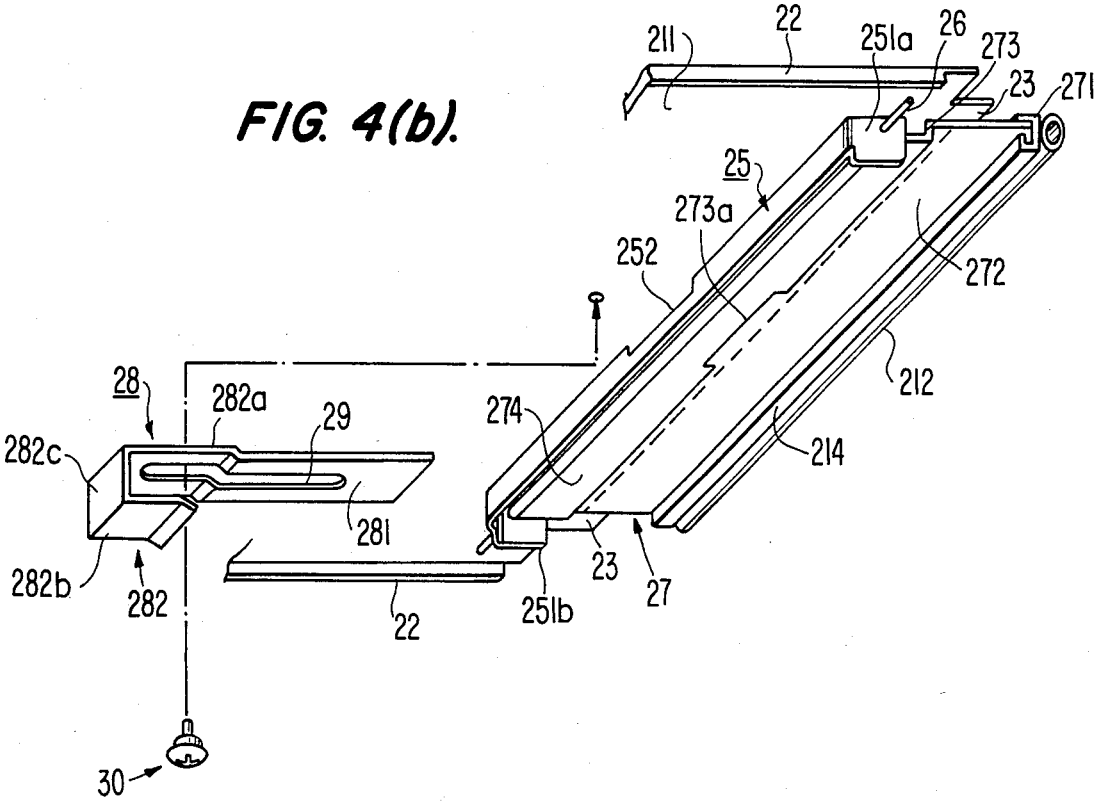

Referring to FIGS. 3 and 4, a display case in accordance with one embodiment of the present invention is shown. The display case is generally indicated by reference numeral 10 and includes a mechanical chamber 11 within which a refrigerating unit is disposed, and a merchandise display compartment 12 which is disposed above mechanical chamber 11 and maintained at a desired predetermined temperature by operation of the refrigerating unit and/or heating equipment.

Display compartment 12 is defined by front side window 13, right and left side windows 14 and 15, a top plate portion 16 and a hinged door 17. The side windows 13, 14 and 15 are assembled with one another by means of frame poles 18. Door 17 comprises frame element 171 and clear window element 172. Frame element 171 is attached to the rear side edges of top plate portion 16, and right and left side windows 14 and 15 to define a rear opening for ready access to display compartment 12. Sealing of the rear opening with respect to door 17 is accomplished by a seal element (not shown) disposed between frame element 171 and the side windows as is known in the art.

A plurality of shelves 20 and at least one partition plate 21 are disposed within display compartment 12 to define a plurality of display/storage spaces. Particularly, partition plate 21 divides the display compartment 12 into two different temperature chambers, such as a refrigerating chamber R and heating chamber H. As clearly shown in FIG. 3, the refrigerating chamber R is positioned in the lower portion of display compartment 12 and is refrigerated by the refrigerating unit in mechanical chamber 11 and heating chamber H is positioned above the refrigerating chamber R and heated by a heating element mounted on partition plate 21.

Partition plate 21 comprises a central base plate 211, packing elements 212 having an annular shaped cross section which are made of soft resin material and L-shaped corner spacers 213. Each packing element 212 is affixed to an attaching element 214 for fixedly disposing element 212 on base plate 211. An inner edge portion of each corner spacer 213 is provided with a thin plate portion which is pressed into contact against the frame pole 18 to secure sealing between corner spacer 213 and frame pole 18. A downwardly bent flange portion 22 is formed on a pair of opposed edges of base plate 211 and a projecting portion 23 is formed on the other pair of opposed edges of base plate 211. The outer edge of corner spacer 213 is engaged with flange portion 22 and projecting portion 23 to support spacer 213. Packing element 212 is supported on flange portion 22 by means of attaching element 214.

A support element 25 extends fromand is fixed on the underside surface of the adjacent projecting portion 23 of base plate 211. Element 25 has supporting flanges 251*a* and 251*b* at both end portions and a cut-out portion 252 at its upper central portion. A supporting shaft 26 extends along support element 25 to be rotatably supported on supporting flanges 251*a* and 251*b*.

A damper element 27 is pivotally supported on supporting shaft 26 and comprises a first downwardly bent flange portion 271, a first flat surface portion 272 extending horizontally from the base of first flange portion 271, a second downwardly bent flange portion 273 formed at the other edge of the first flat surface portion 272, and a second flat surface portion 274 extending horizontally from the lower edge of second flange portion 273. The other end of the second flat surface portion 274 is attached to supporting shaft 26. Therefore, damper element 27 is mounted to swing around supporting shaft 26. One packing element 212 is also disposed and fastened on the first flange portion 271 of damper element 27 through attaching element 214. The second flange portion 273 is formed with a hole 273*a* which is aligned with cut-out portion 252 in support element 25.

A holding element 28 is slidably attached on the undersurface of base portion 211 of partition plate 21. Element 28 comprises a holding portion 281 and U-shaped support base portion 282. Holding portion 281, the upper and lower flanges 282*a* and 282*b* of support base portion 282 are all parallel to each other. Holding portion 281 connects with upper flange 282*a* through a small step portion so as to continue beneath upper flange 272 of damper 27 as shown on FIG. 7(*a*). An elongate slot 29 is formed on holding portion 281 and upper flange 282*a*. Holding element 28 is fastened on the undersurface of base portion 211 by a screw 30 which passes through elongated slot 29. Therefore, holding element 28 is permitted to slide along the undersurface of base portion 211 with screw 30 remaining loose.

Figure 6:
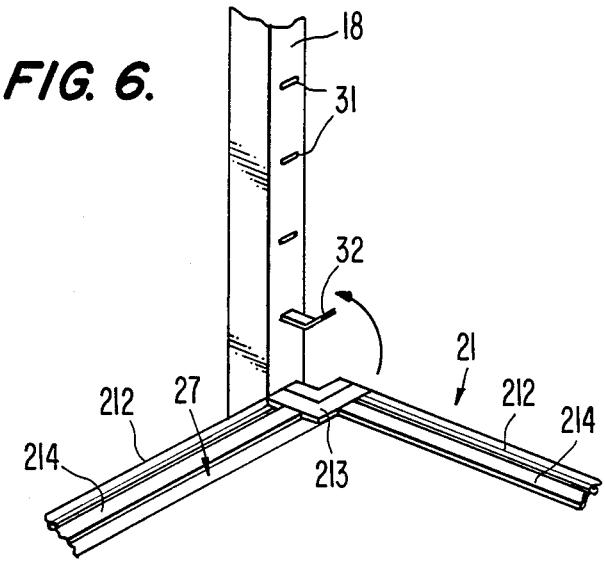
FIG. 6 is an exploded perspective view illustrating the supporting structure for the partition plate on the frame of the display case.

A plurality of hook holes 31 are formed on the inner surface of the respective frame poles 18 as shown on FIG. 6 for receiving a supporting element 22. As shown in FIG. 6, each corner spacer 213 is hung on each frame pole 18 through supporting elements 32. Therefore, partition plate 21 is fixedly mounted in display compartment 12. At this time, the thin plate portion of spacer 213 is firmly contacted against the inner surface of frame pole 18. Also, the position of partition plate 21 can be easily changed by changing the hook position of supporting elements 32.

The operation of damper element 27 will be described with reference to FIG. 7(*a*) and 7(*b*). When the display compartment 12 is to be used as a refrigerating chamber and a heating chamber to store refrigerated and heated merchandise within the same case, each packing element 212 should be in pressure contact against the inner surface of respective windows, as shown inFIG. 7(*a*). That is damper element 27 is rotated to have the first flat surface portion 272 pressed against the undersurface of base portion 211 and the holding portion 281 of holding element 28 is inserted into hole 273*a* of the second flange portion 273 after passing through the cut-out portion 252 of supporting element 25, this action taking place due to sliding motion of holding element 28. At this time, holding portion 281 of holding element 28 contacts with the undersurface of the first flat surface portion 272 of damper element 27. Therefore, damper element 27 is held in its position by holding element 28. Thus the sealing structure between refrigerating chamber R and heating chamber H is completed by means of damper element 27 carrying packing element 212.

Figure 7A:
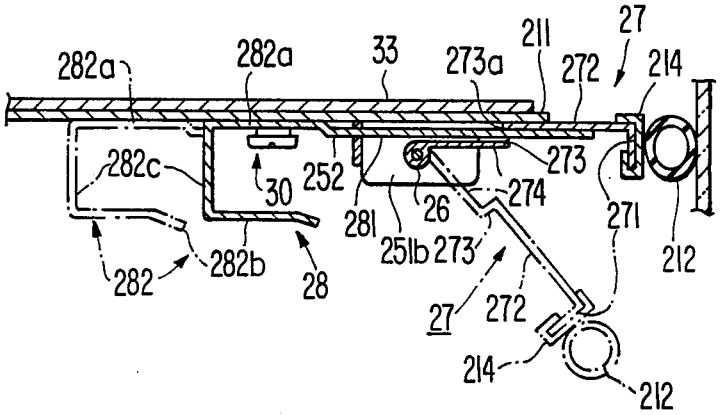
FIGS. 7(*a*) and 7(*b*) are enlarged cross sectional views of the damper element and part of the partition plate illustrating the operation of the damper element.
Figure 7B:
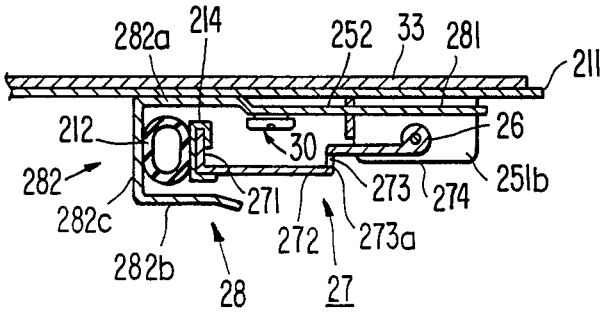

On the other hand, if display compartment 12 is to be used solely as a refrigerating chamber, damper element 27 should be retained by holding element 28 to establish an air gap between each of the windows and the partition plate 21 such as is shown in FIG. 7(*b*) to enable the circulation of cooled air within the whole space of display compartment 12. If the holding portion 281 of holding element 28 is retracted from hole 273*a* in the second flange portion 273 due to inward sliding motion of holding element 28, damper element 27 can be swung downwardly, this position being shown in two-dot and dash lines in FIG. 7(*a*).

Thereafter, damper element 27 is further rotated to a position whereat the first and second flat surface portions 272 and 274 are parallel with the base portion 211 and the holding element 28 has been slid outwardly. Thus, the ouer end portion of damper element 27 including packing element 212 is received in the U-shaped support base portion 282 of holding element 28 as shown in FIG. 7(*b*). In this position, damper element 27 is fixedly supported by the holding element 28 to establish the air gap between the inside surface of each of the side windows and the partition plate 21. Therefore, the cooled air can be circulated within the entire space of display compartment 12 to thereby refrigerate both refrigerating chamber R and heating chamber H.

Figure 5:
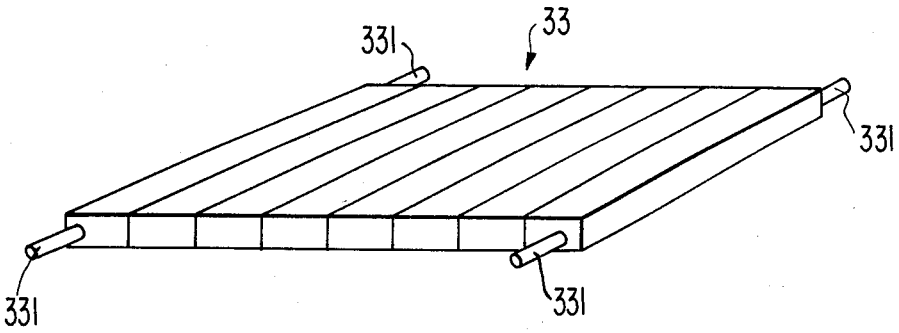
FIG. 5 is a perspective view of heating equipment used in the display case of FIG. 3.

Alternatively, the entire space of display compartment 12 can be used as a heating chamber if operation of the refrigerating unit is ceased and a heating element is put in the display compartment 12. Thus heating equipment 33 is disposed on base portion 211 of partition plate 21. Alternatively, the heating equipment may be separately hung on frame poles 18 through hook pins 331 projecting therefrom. The separately hung heating equipment 33' is shown in FIG. 5.

As mentioned above, the partition and communication between the refrigerating chamber and heating chamber is effectively controlled by swinging operation of the damper element together with its packing element and the damper element is held in the desired position by sliding operation of the holding element. Therefore, the temperature of each divided space is easily changed due to the ease of operation of the damper element. Also, if the damper element is not used, the damper element may be housed in the holding element to extend along the undersurface of the partition plate. Thus, the visibility of the merchandise in the display compartment is not in any way obstructed by the damper element. Furthermore, the partition plate position can be varied in accordance with the required space area to display and store the merchandise by changing the hanging position of the supporting elements.

In the above mentioned partition plate with damper element, if the damper element has its position changed to change the temperature conditions in the chambers due to swinging motion thereof, the damper element may interfere with merchandise stored in the display compartment. Therefore, merchandise placed in the swinging area of the damper element should be moved out of this area, even if sealing between the refrigerating chamber and the heating chamber is secured with ease of operation. One resolution of this problem is shown in FIG. 8 which shows a modified partition plate with sealing structure.

Figure 8:
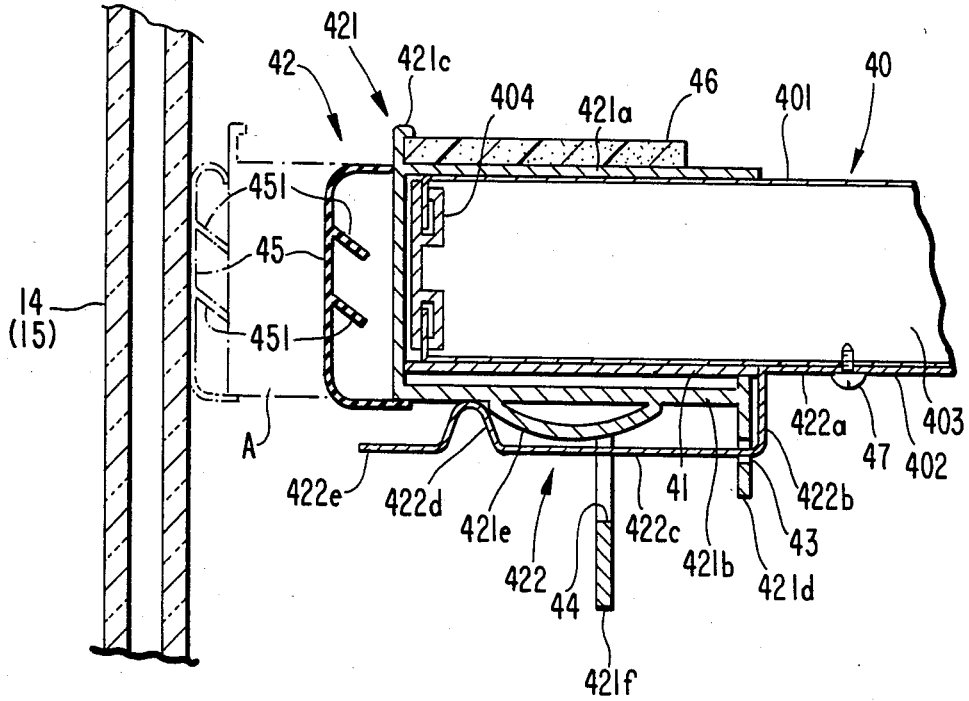
FIG. 8 is an enlarged sectional view of the partition plate and sealing element in accordance with another embodiment of the present invention.
Figure 9:
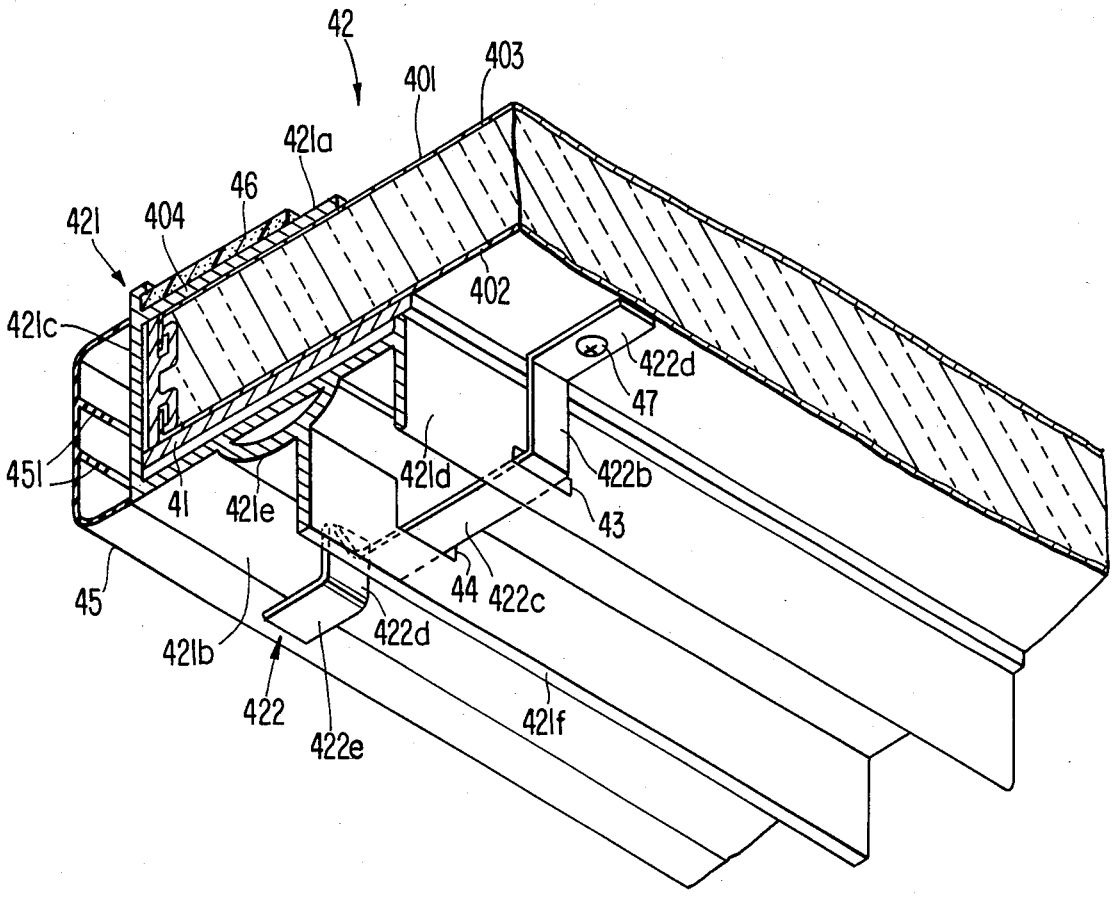
FIG. 9 is a sectional perspective view illustrating the sealing element and part of the partition plate of FIG. 8.

Referring to FIG. 8, partition plate 40 comprises an upper plate 401, lower plate 402 and insulation material, for example, a silicon cotton 403 which is disposed between the upper and lower plates 401 and 402. Each peripheral edge of plate 40 is covered by a holding frame 404 engaged with the upper and lower plates 401 and 402. A sliding plate 41 is attached on the outer edge under portion of lower plate 402. Partition plate 40 is disposed in the display compartment of the display case and an air gap A is defined at the edge surface of partition plate 40 between each of the right and left side windows 14 and 15.

A closing element 42 is slidably disposed on the outer peripheral portion of partition plate 40 to control the opening and lcosing of air gap A. Closing element 42 includes a closing frame 421 slidably disposed on partition plate 40 and a leaf spring 422 to control the horizontal movement of closing frame 421. closing frame 421 is formed to have a U-shaped cross section consisting of an upper plate element **421*a*, lower plate element 421*b* and end plate element 421*c* connected between the upper and lower plate elements at its ends. A vertical flange portion 421*d* which is disposed on the end portion of lower plate element 421*b* and a curved portion 421*e* which is located on the end surface of lower plate element 421*b* are integrally formed with closing frame 421. A second verticle flange portion 421*f* projects from the outer surface of curved portion 421*e* and is also integrally formed with closing frame 421. Vertical flange portion 421*d* and second vertical flange portion 421*f* are formed with rectangular shaped holes 43 and 44**, respectively, these holes being aligned with one another.

A U-shaped packing element 45 made of vinyl chloride is disposed on the end portion of partition plate 40 to secure sealing between the window and the closing element without damage to the window. Packing element 45 has a plurality of projections 451 extending generally horizontally from the inner surface thereof to increase the durability of the packing element. Also, insulation plate 46 made of foam polyethylene is disposed on the upper surface of the upper plate element 401.

Leaf spring 422 is formed with an L-shaped and provided with a fastening portion **422*a* extended from vertical portion 422*b*. Leaf spring 422 is fastened on lower plate 402 of partition plate 40 by a screw 47 extending through fastening portion 422*a*. A free end of horizontal portion 422*c* of leaf spring 422 is provided with a U-shaped retaining portion 422*d* and free terminal end 422*e*. Horizontal portion 422*c* extends horizontally along lower plate element 421*b* and passes through rectangular holes 43 and 44 of closing frame 421. Retaining portion 422*d* is normally disposed on the outer side of the second vertical flange portion 421*f* and presses upwardly to contact against the lower plate element 421*b* and curved portion 421*e* of closing element 42 due to the biasing strength of leaf spring 422**.

In the above construction of closing element 42, if the display compartment 12 is used as a refrigerating chamber and also as a heating chamber, closing element 42 should be slid by grapsing second vertical flange **422*f* toward the side window 14 or 15, opposing the biasing strength of leaf spring 422. At this time, packing element 45 is firmly contacted against the side window 14 or 15 to secure sealing or closure of air gap A. This position of the closing element is shown by two-dot and dash lines in FIG. 8. When closing element 42 is positioned to seal the air gap A, retaining portion 422*d* of leaf spring 422 is positioned between curved portion 421*e* and vertical flange portion 421*d* in pressure contact with lower plate element 421*b* of closure framer 421. Therefore, the position of closing frame 421** is securely maintained.

On the other hand, if display compartment 12 is entirely used as a refrigerating chamber or heating chamber, closure element 42 should be shifted to the peripheral edge of partition plate 40 to establish the air gap A. This position is shown in solid lines in FIG. 8. At this time, retaining portion **422*d* of leaf spring 422 is disposed on the outer edge of curved portion 421*e*. Therefore, sliding movement of closing element 421** is prevented to thereby maintain the opening of air gap A.

A mentioned above, the closing frame to control the openign and closing of the air gap defined between the side window and partition plate is slidably disposed on the peripheral edge portion of the partition plate and movement of the closing frame is controlled by the leaf spring. Therefore, each of the display/storage chambers formed in the display compartment is easily changed as to temperature conditions and control of the closure frame without interferring with the stored merchandise.

This invention has been described in detail in connection with preferred embodiments. However, the embodiments are merely for example only and the present invention is not to be restricted thereto. It will be easily understood by those skilled in the art that other variations and modifications can be made within the scope of this invention as defined by the appended claims.

We claim:

1. In a display case including a mechanical chamber having a refrigeration unit disposed therein and provided with a compartment for display and storage of merchanidse, said display compartment being defined by a front window, right and left windows, a top plate portion and hinged door, and said front, right and left windows being attached together by frame elements, at least one impervious partition plate disposed within said display compartment to divide said compartment into two chambers, a gap defined between at least one of said windows and an edge portion of said partition plate for said chambers to communicate with one another through said gap to vary the temperature condition of each of said chambers by opening and closing said gap, and a sealing mechanism to control opening and closing said gap, the improvement comprising said sealing mechanism including a sealing element movably engaged with said partition plate to engage with at least one of said windows so as not to allow air to pass through said gap when such window is engaged and a retaining element to hold the selected position of said sealing element.

2. The display case of claim 1 wherein said sealing element is a damper pivotally supported on the underside surface of said partition plate, and said retaining element is attached on said underside surface of said partition plate.

3. The display case of claim 2 wherein said retaining element is formed as a tang-shaped plate to extend along and slidably engage said underside surface of said damper, said plate being slidably attached on said partition plate.

4. The display case of claim 3 wherein said retaining element has a U-shaped holding portion at one end portion for receiving the outer end portion of said damper when said damper is moved to a position to open said gap.

5. The display case of claim 2 wherein said damper is provided with a packing element at its outer end surfce for securing the sealing of the gap without damage to said window.

6. The display case of claim 1 wherein said sealing element is formed with a U-shaped cross section for receiving the outer end portion of said damper when said damper is moved to a position to open said gap, said sealing element being slidably disposed on an outer edge portion of said partition plate.

7. The display case of claim 6 wherein said retaining element is a leaf spring which is provided with a contact portion pressed against said sealing element due to the biasing strength thereof.

8. The display case of claim 6 wherein said sealing element is provided with a packing element on its outer end portion to secure sealing of the gap without damage to said window.

9. The display case of claim 6 wherein said seal element has a holding portion for easy movement thereof.

* * * * *